US005513801A

United States Patent [19]

Hühne et al.

[11] Patent Number: 5,513,801

[45] Date of Patent: May 7, 1996

[54] PRESSURE COMPENSATION CHAMBER HAVING AN INSERTION ELEMENT

[75] Inventors: Erwin D. Hühne, Schallstadt, Germany; Franz Künzli, Wangen bei Dübendorf, Switzerland

[73] Assignees: UTP Schweissmaterial GmbH & Co, KG, Bad Krozingen, Germany; Franz Kunzli AG, Dubendorf, Switzerland

[21] Appl. No.: 202,093

[22] Filed: Feb. 25, 1994

[30] Foreign Application Priority Data

Feb. 26, 1993 [DE] Germany ..... 43 05 896.5

[51] Int. Cl.[6] ..... B05B 7/20

[52] U.S. Cl. ..... 239/419.3; 239/422; 239/424

[58] Field of Search ..... 239/419, 419.3, 239/422–424, 427–427.5, 428

[56] References Cited

U.S. PATENT DOCUMENTS

| | | | |
|---|---|---|---|
| 2,367,316 | 1/1945 | Skinner | 239/419 X |
| 2,392,593 | 1/1946 | Jenkins | 239/419 X |
| 2,920,001 | 1/1960 | Smith et al. | 239/422 X |
| 4,136,827 | 1/1979 | Mushenko et al. | 239/419.3 |
| 4,361,285 | 11/1982 | Koppehele et al. | 239/424 |
| 4,363,443 | 12/1982 | Huehne | 239/422 X |
| 4,375,954 | 3/1983 | Trudel | 239/419.3 X |
| 4,821,963 | 4/1989 | Arnout et al. | 239/419.3 |

FOREIGN PATENT DOCUMENTS

| | | | |
|---|---|---|---|
| 1084684 | 1/1955 | France | 239/419.3 |
| 1003004 | 2/1957 | Germany | 239/423 |
| 626313 | 8/1978 | U.S.S.R. | 239/419.3 |

*Primary Examiner*—Andres Kashnikow
*Assistant Examiner*—Lesley D. Morris
*Attorney, Agent, or Firm*—Staas & Halsey

[57] ABSTRACT

The invention relates to a burner head for burner units, comprising a single or multiple injector gas mixing system for the interior and/or exterior mixing of various fuel constituents, particularly fuel gases, auxiliary combustion gases and possibly liquid fuel gases, formed by an intermediate piece in which feed ducts for the fuel constituents are provided from an equipment connecting surface to a nozzle connecting side, and comprising a nozzle which consists of a center part having ducts and at least one cap part, for the mixing of at least two fuel constituents, the first ducts assigned to a first fuel constituent and distributed around the circumference leading into first injector nozzle bores which, in turn, are connected with a radial injector gap formed by an annular gap between the center part and the cap part, and the second ducts assigned to the second fuel constituent and distributed around the circumference also leading into the radial injector gap, in which case, in the intermediate piece, radial-axial pressure compensation chambers are, on the one side, connected with the individual distributor grooves and, on the other side, with the pertaining feed ducts of the various fuel constituents, and in which case preferably the cap part is provided with nozzle ducts which, in the installed position, are aligned with the injector nozzle bores, and completely covers the center part in the direction of the burner head face pointing to the flame, with the exception of the possibly existing spraying filler guide duct.

23 Claims, 8 Drawing Sheets

PRESSURE COMPENSATION CHAMBER HAVING AN INSERTION ELEMENT

BACKGROUND OF THE INVENTION

1. Field of the Invention

The invention relates to a burner head for burner units, comprising a single or multiple injector gas mixing system for the interior and/or exterior mixing of various fuel constituents, particularly fuel gases, auxiliary combustion gases and possibly liquid fuel gases, formed by an intermediate piece in which feed ducts for the fuel constituents are provided from an equipment connecting surface to a nozzle connecting side, and comprising a nozzle which consists of a center part having ducts and at least one cap part, for the mixing of at least two fuel constituents, the first ducts assigned to a first fuel constituent and distributed around the circumference leading into first injector nozzle bores which, in turn, are connected with a radial injector gap formed by an annular gap between the center part and the cap part, and the second ducts assigned to the second fuel constituent and distributed around the circumference also leading into the radial injector gap.

2. Description of the Related Art

A burner head of this type is used, for example, in welding torches, cutting torches, flame chipping torches or preheating torches, in flame spraying equipment or high-speed flame spraying torches for the spraying of wire-shaped, rod-shaped and/or powdery spraying filler metals as well as in high-flame pressure burners, for producing synthetic diamond layers on substrate surfaces and consisting of a hydrocarbon-oxygen high-speed flame with a high flame pressure.

A burner head of the initially mentioned type is known from German Patent Document DE 30 33 579. There, the burner head consists of an intermediate piece with feed ducts and distributor grooves which are connected with the feed ducts as well as of a nozzle which is formed of a center part with ducts and a cap part. The feeding of fuel constituents into the intermediate piece takes place through individual separate lines which lead into the respective distributor grooves. Between the center part and the cap part of the nozzle, an annular gap is provided which is used as a duct for one fuel constituent and leads into a radial injector gap. The other fuel constituent is guided through nozzle ducts designed as bores in the center part also into the radial injector gap.

The distributor grooves lead the respective fuel constituent into the respectively provide group of feed ducts in the intermediate piece which are distributed around the circumference. However, it is found in this case that the fuel constituent, which usually flows in at a high pressure and at a high speed, is not distributed uniformly into all feeding ducts pertaining to the respective group but that the fuel constituent in the feed ducts which are closest to the gas supply are guided to the nozzle at a higher pressure than in the feed ducts which have a larger distance. This asymmetrical pressure distribution has the very disadvantageous result that the burner flame does not develop in a rotationally symmetrical manner and deviates in its flame direction from the center axis of the burner head.

SUMMARY OF THE INVENTION

The invention is therefore based on the object of providing a burner head which eliminates the above-described disadvantages and which therefore produces a flame which develops rotationally symmetrically around the burner head axis.

According to the invention, this object is achieved in that, in the intermediate piece, distributed around the circumference, radial-axial pressure compensation chambers are connected on the one side with the individual fuel constituent feed lines and, on the other side, with the pertaining feed ducts of the intermediate piece.

The radial-axial pressure compensation chambers change the flow direction of the fuel constituents such that the more or less direct axial flowing through of the fuel constituent is prevented.

It is therefore achieved that the dynamic pressure of the fuel constituent within the radial-axial pressure compensation chamber is compensated in its whole volume. This results in the advantage that the fuel constituent flows in the individual feed ducts distributed around the circumference of a respective feed duct group which is each assigned to one fuel constituent, are identical with respect to pressure, speed and quantity which, after the mixing and ignition of the fuel constituents on the burner head face, finally results in a symmetrical flame aspect and in an optimal combustion.

Special advantages are obtained when the cap part of the burner head according to the invention is provided with nozzle ducts which are distributed around the circumference and in the installed position are aligned with the injector nozzle bores and completely covers the center part in the direction of the burner head face pointing to the flame, with the exception of a possibly existing spraying filler guide duct. The reason is that, in the case of a burner head according to the state of the art, the center part of the nozzle becomes very hot because of the flame development on the face of the center part, mainly when, in the case of high-speed flame spraying, a burner chamber with an expansion nozzle is additionally mounted on the face of the burner head. An insulated cooling for the center part of the nozzle would, because of its poor accessibility, result in high constructional expenditures and would be extremely difficult.

In contrast, as a result of the preferred arrangement of the center part and the cap part of the nozzle according to the invention, the center part is shielded from the flame by the cap part. This measure by itself has the result that the thermal stress to the center part is clearly reduced. Furthermore, the heat generated on the burner head face is carried off within the cap part and therefore to the exterior side of the nozzle which is easily accessible for a cooling device. This also eliminates in a surprisingly simple manner the additional disadvantage of a burner head according to the state of the art which, because of the construction of the one fuel constituent duct as an annular gap between the center part and the cap part has only very few contact surfaces between these two parts and therefore has a deficient heat transfer from the center part to the cap part of the nozzle.

In a constructively simple and therefore preferred embodiment of the burner head according to the invention, the radial-axial pressure compensation chambers have an annular construction. In this case, it may be useful to arrange the individual radial-axial pressure compensation chambers of the individual fuel constituents on circles which are concentric with respect to the center axis of the burner head. This will be particularly advantageous when the individual groups of feed ducts assigned to the individual fuel constituents in the intermediate piece are also arranged on concentric circles.

The radial-axial pressure compensation may take place by means of baffles integrated in the radial-axial pressure compensation chambers, that is, flow-direction-changing elements may advantageously be made of stainless steel or of brass but which may also be formed by one or by several exchangeable filter stages. When the baffles are constructed as filter stages, there is the additional advantage that possibly existing contaminations of the fuel constituents may be intercepted and can then no longer result in a clogging of the injector nozzle bore or of the radial injector gap.

In the case of an annular construction of the radial-axial pressure compensation chamber, it is expedient to also construct the baffles in an annular or rotationally symmetrical manner.

In addition to being provided with labyrinth-type baffles, the radial-axial pressure compensation chambers may also be provided with a gas-permeable porous material which also prevents the smooth flowing through of the fuel constituents from the distributor grooves into the closest feed ducts and therefore ensures the radial-axial pressure compensation. The radial-axial pressure compensation chambers may be partially or completely filled with this material.

The gas-permeable porous material may be a ceramic foam or a ceramic preform. An open-pore sintered metal is advantageous for this purpose.

For the optimal carrying-off of heat from the center part into the cap part of the nozzle, it is advantageous to construct the exterior fuel constituent guides, which lead into the radial injector gap, not as an annular gap but as individual fuel constituent ducts which are distributed around the circumference and whose clearances form thermal bridges between the center part and the cap part. This considerably increases the heat transfer speed, reduces the thermal stress to the center part by a better carrying-off of the heat and prevents warping between the center part and the cap part caused by temperature differences. Constructively, it is very simple to produce these fuel constituent ducts by grooves in the center part or in the cap part distributed around the circumference. The remaining raised clearances will then be used as a thermal bridge. This has the additional advantage that a press fit takes place between the center part and the cap part.

Expediently, the cap part is surrounded by a cooling space which holds a heat-dissipating medium, in which case the heat-dissipating medium may be cooling water.

Particularly, when a combustion chamber is used which is connected behind and has an expansion nozzle in which temperatures of up to 3,000° C. may occur, an efficient cooling of the nozzle, particularly of the burner head face, is of utmost importance.

Advantageously, the combustion chamber which is connected behind, the transition cone and the expansion nozzle are also surrounded by a cooling jacket in which cooling ducts are situated which are connected with the cooling space around the cap part of the nozzle. Thus, an efficient cooling of the whole front area of the burner head is implemented in a simple manner by means of a single cooling circulation system.

Deviating from the normal assignment of the fuel constituents to the ducts and the injector nozzle bores of the burner head, it may, in the case of the burner head according to the invention, be expedient to guide the possibly existing liquid fuel—fuel constituent by way of the injector nozzle bore under pressure into the radial injector gap into which oxygen is fed as an injection medium, instead of vice versa.

A liquid fuel constituent which is fed to the burner head according to the invention, does not have to be a single constituent but may advantageously also consist of an already gasified liquid fuel and/or a liquid fuel which is already mixed with oxygen.

According to a preferred construction of a burner head according to the invention, the intermediate piece has on its equipment connecting surface separate distributor grooves which are closed off to the outside in a gastight manner, one group of feed ducts respectively leading into the distributor grooves. These distributor grooves connect the individual fuel constituent feed lines with the pertaining feed ducts of the intermediate piece and with the pertaining radial-axial pressure compensation chambers. As a result, it is advantageously possible to guide various equipment-side fuel constituent connections, arranged approximately on a radius around the center axis of the burner head, by way of the fuel constituent feed lines into the distributor grooves through which each individual fuel constituent will then be guided into the pertaining feed ducts of the intermediate piece which are each arranged on different radii distributed on the circumference around the center axis of the burner head.

The invention offers special advantages when a spraying filler feed duct is surrounded by a coaxial duct in the intermediate piece and is surrounded by a coaxial annular duct in the center part, the coaxial annular duct leading into an annular duct which coaxially surrounds the spraying filler guide duct in the cap part. As a result of these ducts which coaxially surround the spraying filler guide duct, the spraying filler jet which emerges from the spraying filler guide duct can be enveloped by a gas which emerges coaxially around it from the burner head face. This gas may be a reaction gas. However, particularly for low-melting spraying fillers, it is particularly advantageous to use a cooling gas which may, for example, be inert.

In order to ensure a precise centering of the cap part and the center part despite the coaxial ducts, it is expedient to arrange in the contact area of the center part and the cap part, a centering ring with passage bores in the coaxial annular duct.

For the equal distribution of the enveloping gas along the whole circumference of the annular duct from which it emerges on the burner head face while surrounding the spraying filler jet, a pressure compensation annulus is preferably arranged at least between the coaxial annular duct of the center part and the annular duct of the cap part. Gas distributor bores which are distributed around the circumference and may be arranged between the coaxial duct of the intermediate piece and the coaxial annular duct of the center part are used for the same purpose.

The charging of the coaxial ducts preferably takes place by way of an enveloping-gas feed line which is connected with the coaxial duct of the intermediate piece by means of an enveloping gas duct and a distributor annulus which is used for the equal distribution of the enveloping gas.

Preferably, water vapor, particularly overheated water vapor, flows through the coaxial duct of the intermediate piece, the coaxial annular duct of the center part and the annular duct of the cap part. Predominantly when liquid fuel constituents are used, the water vapor or the overheated water vapor, which is supplied in this manner to the flame as a filler medium, can improve the combustion so that a better utilization of energy and a clean, no-residue combustion are obtained.

BRIEF DESCRIPTION OF THE DRAWINGS

Embodiments of the burner head according to the invention will be explained in detail in the following by means of the drawings.

DETAILED DESCRIPTION OF THE PREFERRED EMBODIMENTS

Figure 1:
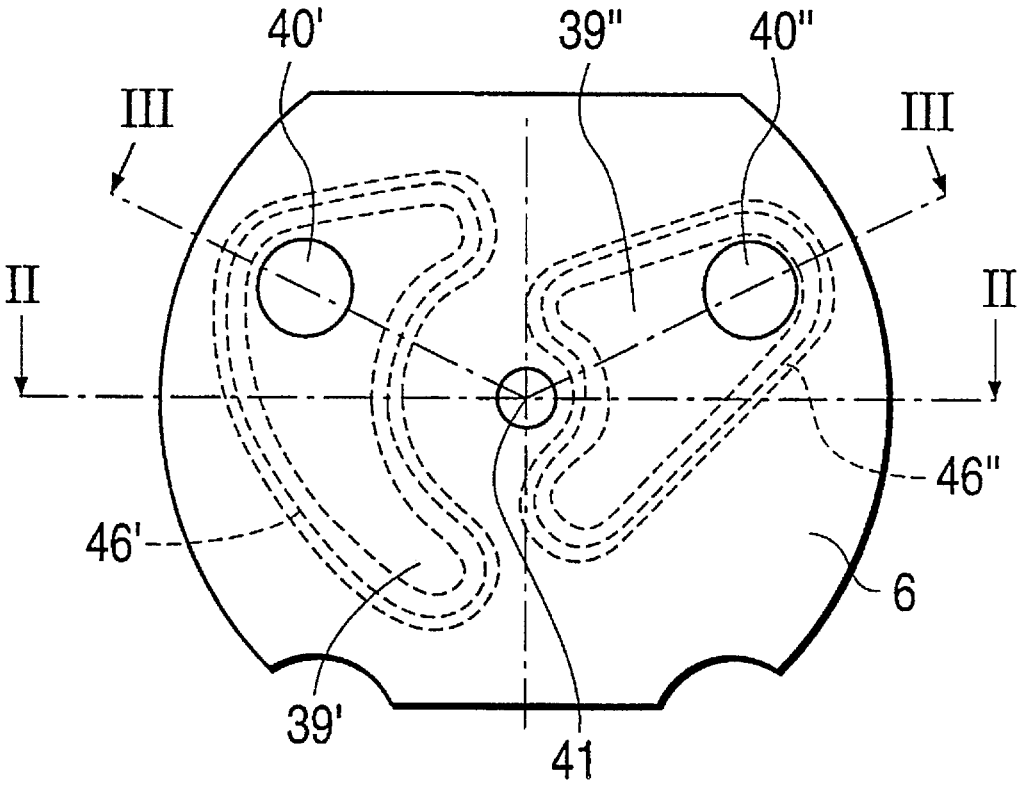
FIG. 1 is a view of the equipment connecting surface of a burner head according to the invention.

FIG. 1 is a view of an equipment connecting surface 6 with two fuel constituent feed lines 40' AND 40" (collectively denoted 40) as well as a spraying filler feed line 41. According to this embodiment of the invention, two fuel constituents, for example, oxygen and acetylene, are to be mixed within the nozzle, in which case a spraying filler, such as a metal powder, is to be admixed to the flame on the burner head face. The fuel constituents, which flow through the fuel constituent feed lines 40 into the burner head, must now, each separately, distributed along the circumference, be led on to the nozzle, in this embodiment, on circles which are concentric with respect to the spraying filler feed line 41. For this purpose, the fuel constituent flows into the distributor grooves 39' and 39" (collectively denoted 39) which are sealed off with respect to one another and toward the outside by means of O-rings inserted into the sealing grooves 46' and 46" (collectively denoted 46).

Figure 2:
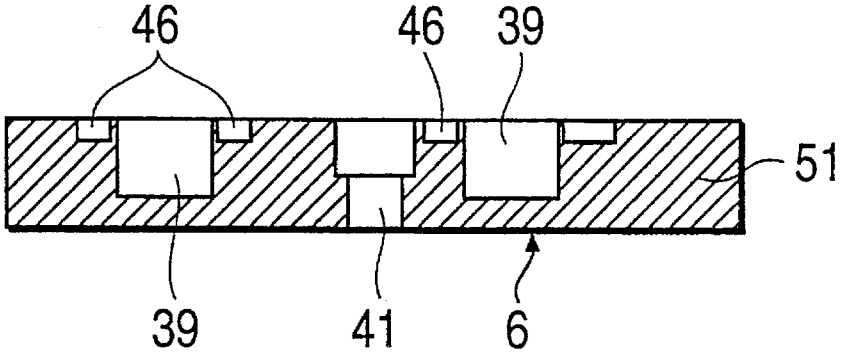
FIG. 2 is a sectional view of the equipment connecting plate of a burner head according to the invention along II—II of FIG. 1.

For reasons of simplification, the sectional view II—II in FIG. 2 shows only the equipment connecting plate 51 of the intermediate piece 1, illustrated by the course of the distributor grooves 39 and their assigned sealing grooves 46 which receive O-ring seals.

Figure 3:
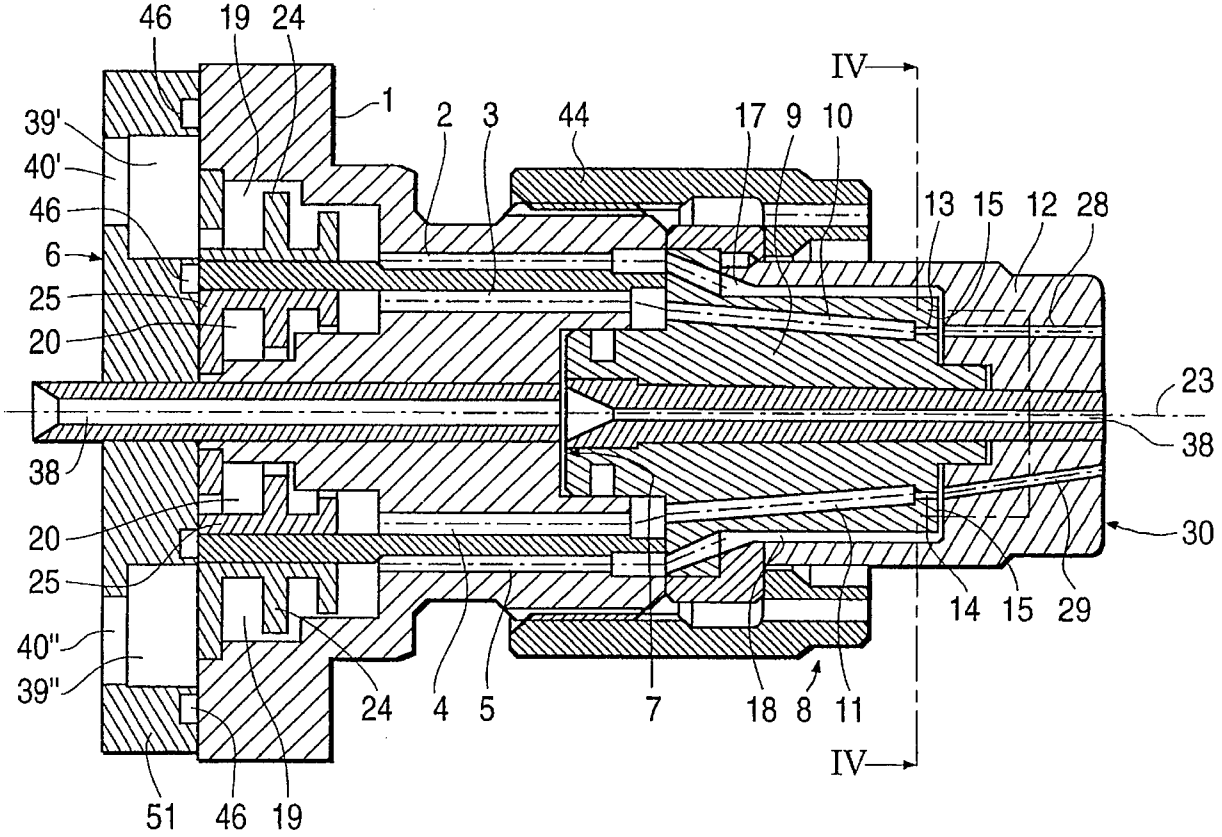
FIG. 3 is a sectional view of a burner head according to the invention along III—III of FIG. 1.

FIG. 3 finally illustrates the solutions to the object of the invention on this special embodiment with two fuel constituents and a spraying filler. The section of FIG. 3 extends according to III—III of FIG. 1. This clearly demonstrates the distributor function of the distributor groove 39' which leads the first fuel constituent from the fuel constituent feed line 40' separately from the other fuel constituent, into the feed ducts 2 and 5 which are distributed on the circumference and are farther away from the center axis 23 of the burner head. The sealing grooves 46 for receiving the O-rings are clearly visible.

The other fuel constituent is guided from the fuel constituent feed line 40" by way of the distributor groove 39" to the feed ducts 3 and 4 in the intermediate piece 1 which are distributed on the circumference and which are situated farther on the inside viewed from the center axis 23. The fuel constituent feed lines 40 are situated only on one point of the burner head circumference, but the feed ducts 2, 3, 4, 5 are distributed uniformly along its circumference. In order to now ensure a uniform distribution to the feed ducts 2 and 5 or 3 and 4, the fuel constituents are guided from the distributor grooves 39 first into rotationally symmetrical radial-axial pressure compensation chambers 19, 20 which are arranged concentrically around the center axis 23, where they are equally distributed by means of baffles 24, 25 in their dynamic pressure as well as according to quantity along the whole circumference. It is only then that the fuel constituents are guided along into the feed ducts 2, 3, 4, 5.

On the nozzle connecting side 7, the feed ducts 2, 3, 4, 5 lead into the respective pertaining ducts 10, 11, 17, 18 of the nozzle 8 which is fastened on the intermediate piece 1 by means of a cap nut 44. The radially interior ducts 10, 11 lead into injector nozzle bores 13, 14 with a reduced cross-section, whereby the speed of the fuel constituent guided here , such as oxygen in this case, is increased to an extreme degree. The radially exterior ducts 17, 18 which are arranged between the center part 9 and the cap part 12, are led to an annular gap 15 which becomes a radial injector gap also denoted with reference numeral 15, by the simultaneous junction of the injector nozzle bores 13, 14.

In these exterior ducts, acetylene, for example, which, for reasons of safety, can be supplied in the feed line at only a low pressure, is in this case guided into the radial injector gap 15. There, it is pulled along by the high-speed oxygen jet from the injector nozzle bores 13, 14, into the nozzle ducts 28, 29 which are alternatingly constructed to be axial and focussing. The resulting fuel gas mixture emerges on the burner head face 30 and will then be ignited.

In this case, the center part 9 of the nozzle 8 is spaced away from the burner head face 30 so that its thermal stress is kept within limits. The heat is dissipated inside the cap part 12 from the burner head face 30. This embodiment of a burner head according to the invention may be used for flame spraying. For this reason, a spraying filler guide duct 38 is fitted along the center axis 23.

Figure 4:
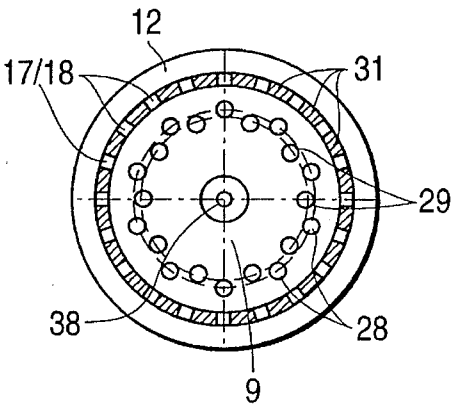
FIG. 4 is a sectional view IV—IV according to FIG. 3.

FIG. 4 illustrates the alternating axial and focussing design of the nozzle ducts 28 and 29 in the sectional view IV—IV according to FIG. 3. It is also clearly shown here that the radially exterior ducts 17, 18 are formed by grooves distributed on the circumference in the center part 9, whereby a press fit is created between the cap part 12 and the thermal bridges 31 of the center part 9 which bridges remained standing. It is directly demonstrated that, as a result, the heat compensation is significantly improved between the center part 9 and the cap part 12 in comparison to a duct 17, 18 constructed as an annular gap.

Figure 5:
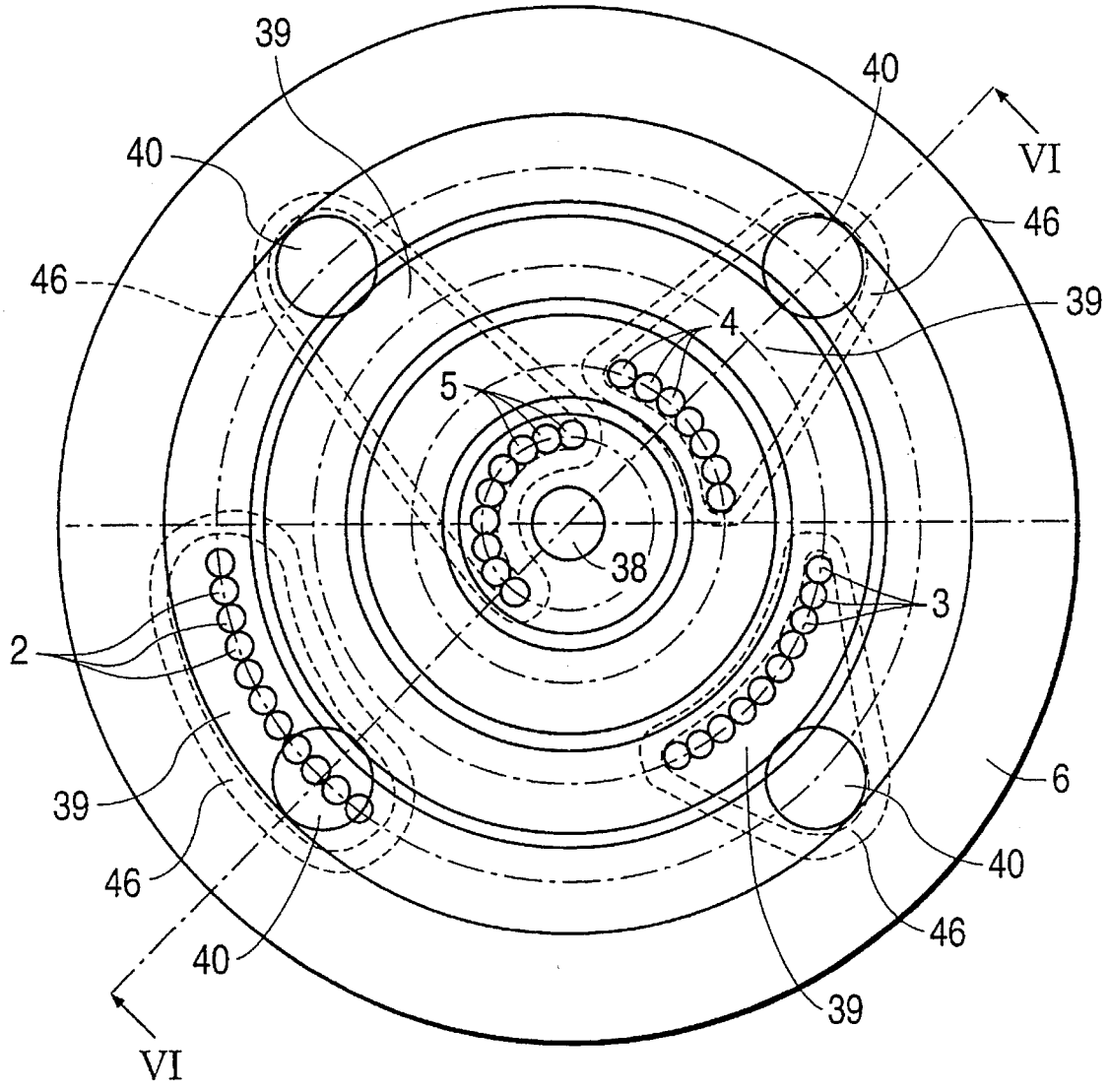
FIG. 5 is a view of the equipment connecting surface of another embodiment of the burner head according to the invention.
Figure 6:
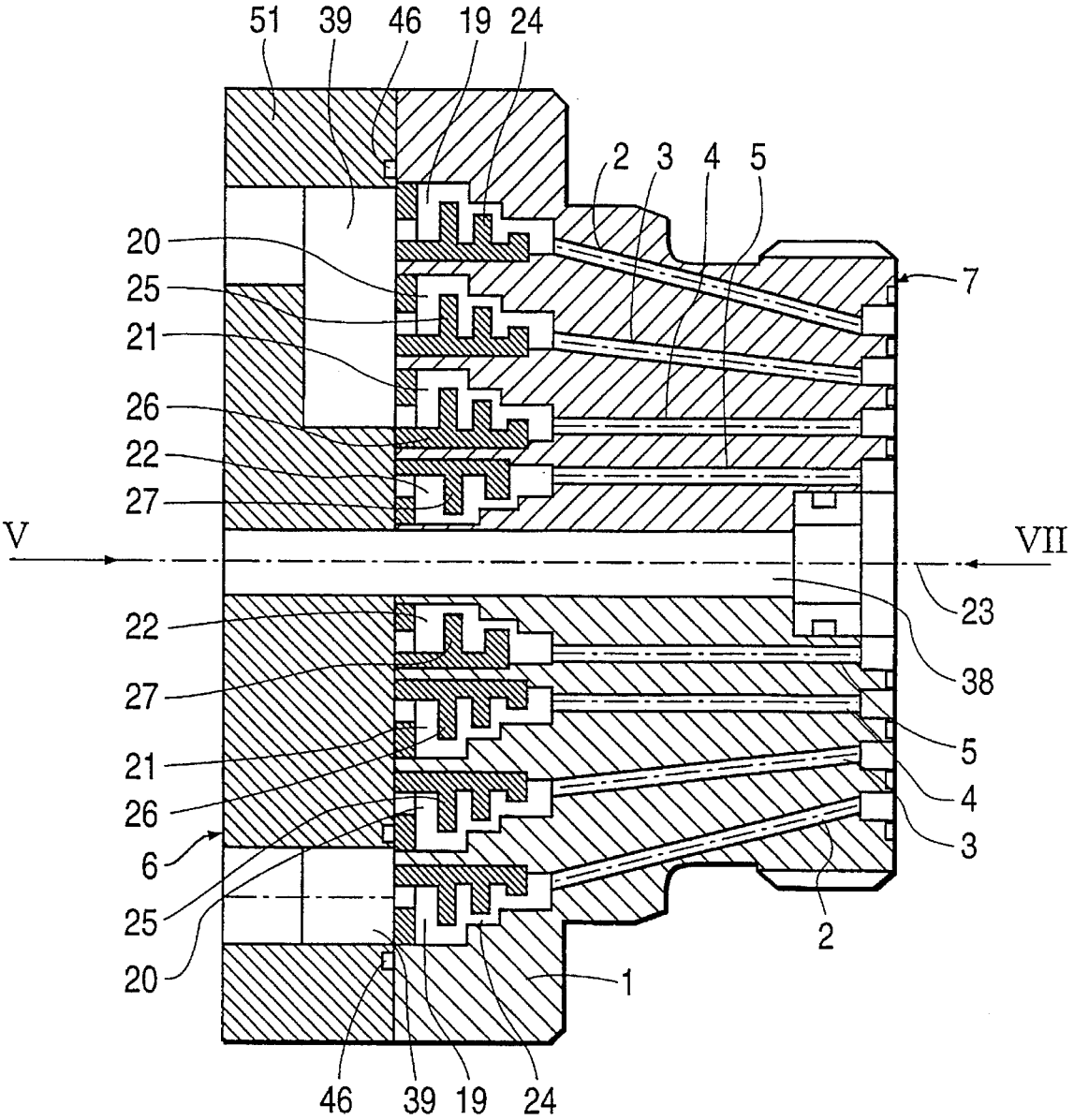
FIG. 6 is a sectional view of the intermediate piece of a burner head according to the invention along VI—VI of FIG. 5.
Figure 7:
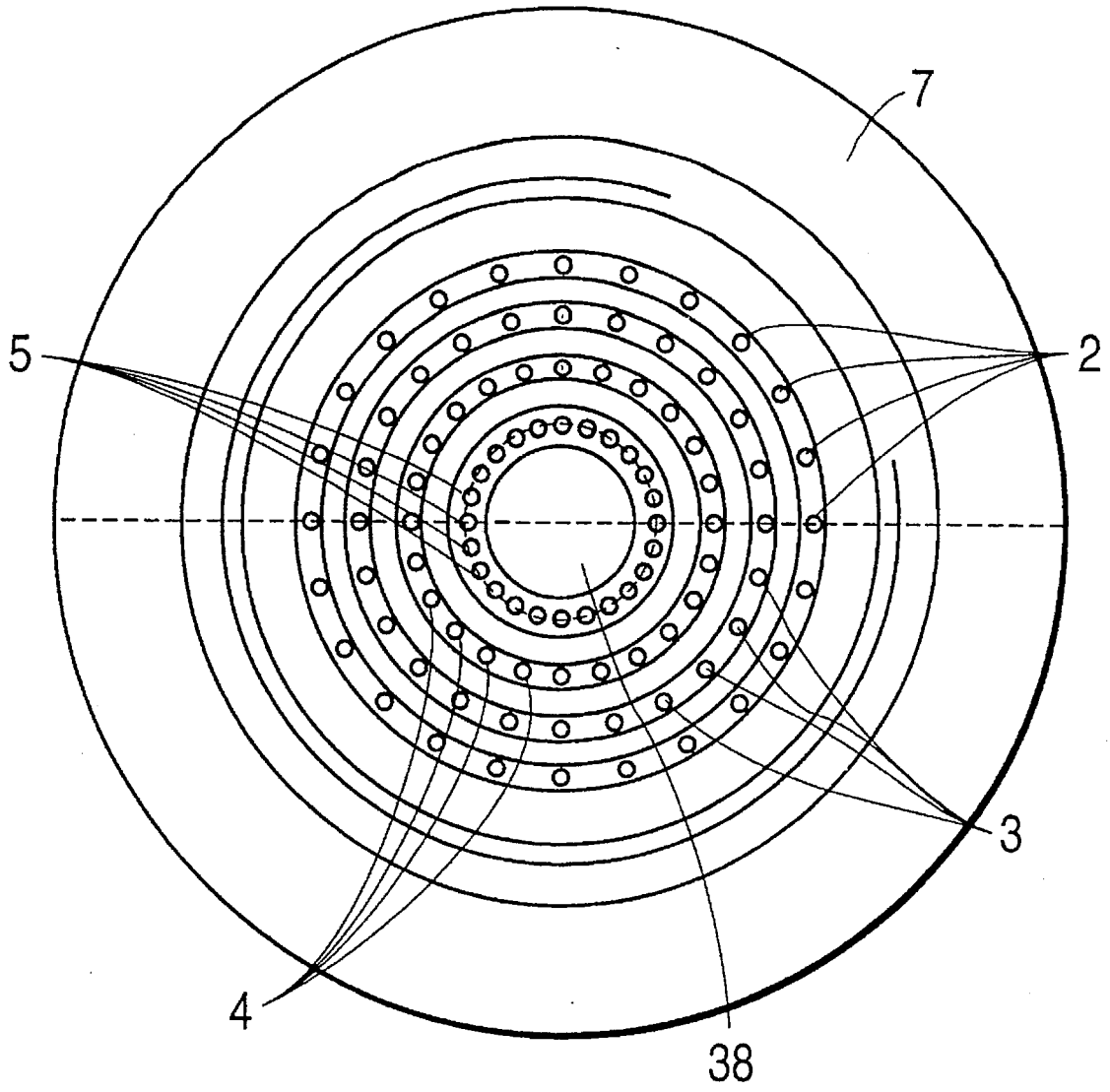
FIG. 7 is a view in the direction VII according to FIG. 6.

FIGS. 5–7 are views of another embodiment according to the invention. The reference numerals in FIGS. 5–7 denote structures which corresponds to structures denoted with the same reference numerals in FIGS. 1–4. FIG. 5 is a view of an equipment connecting surface 6 of a burner head comprising four different fuel constituent feed lines 40 and one spraying filler feed duct 38.

It is schematically shown here how the fuel constituents are guided by way of the individual distributor grooves 39 to the feed ducts 2, 3, 4, 5 which are situated on different concentric circles and are not visible in this view. This also very clearly shows the problem of the rotationally symmetrical pressure distribution of the fuel constituents into the different feed duct groups° The distributor grooves 39 are, in turn, sealed off by O-rings inserted into the sealing grooves 46.

FIG. 6 shows the intermediate piece 1 in the sectional view VI—VI according to FIG. 5. FIG. 5 is therefore a view in the direction V of FIG. 6. Here, it is also clearly shown how the annular baffles 24, 25, 26, 27 arranged in the radial-axial pressure compensation chambers 19, 20, 21, 22 provide the radial-axial pressure compensation and thus a pressure distribution of the individual fuel constituents into the feed ducts 2, 3, 4, 5 which is uniform on the whole circumference of the burner head. Here also, the spraying filler guide duct 38 is fitted in along the center axis 23.

FIG. 7, which is a view in the direction VII of FIG. 6, illustrates that the four different fuel constituents on the nozzle connecting side 7 are now guided in feed duct groups 2, 3, 4, 5 which are situated on concentric circles and distributed on the circumference.

Figure 8:
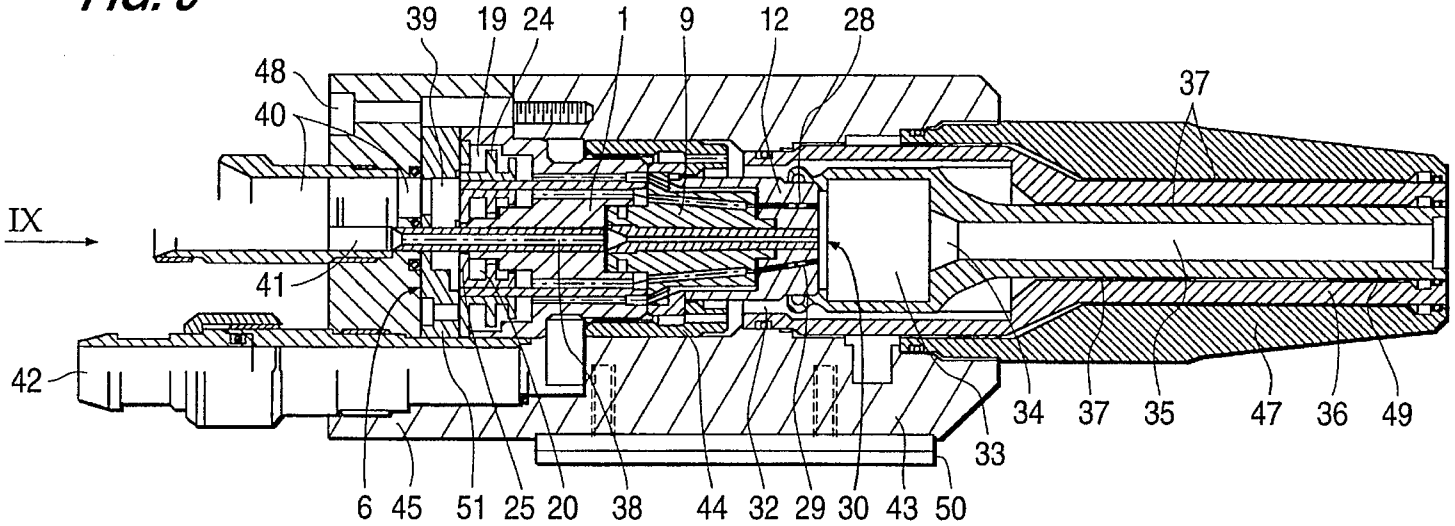
FIG. 8 is a sectional view of a burner gun with a burner head according to the invention.

FIG. 8 shows how an embodiment of the burner head according to the invention, with the intermediate piece 1, the center part 9 and the cap part 12, is integrated into a burner gun. On the burner head side 30, the nozzle ducts 28, 29 carrying the fuel constituent mixture lead into a combustion chamber 33 which by way of a transition cone 34 continues in an expansion nozzle 35. The spraying filler guide duct 38 also leads into the combustion chamber 33. The equipment connecting surface 6 of the intermediate piece 1 is connected by means of screws 48 with a connection piece 45 in which cooling water connections 42 are situated as well as two fuel constituent feed lines 40 and a spraying filler feed line 41. As indicated in the above-mentioned examples, the fuel constituents are guided from the fuel constituent feed lines 40 by way of the distributor grooves 39 to the radial-axial pressure compensation chambers 19, 20 with their baffles 24, 25, from where they are led by way of the feed ducts 2, 3, 4, 5 to the nozzle 8. The cooling of the nozzle 8 takes place by way of a cooling water circulating system. For this purpose, the cooling space 32 surrounding the cap part 12 is connected with cooling water connections 42.

The cooling of the combustion chamber 33, the transition cone 34 and the expansion nozzle 35 takes place in the cooling jacket 36 by means of the cooling ducts 37 connected with the cooling space 32 and therefore in the same cooling water circulating system. In this example, the cooling ducts are formed by annular gaps between the cooling jacket 36 and the expansion nozzle wall 49, on the one hand, and between the cooling jacket 36 and the exterior screw sleeve 47, on the other hand. The whole burner gun can be mounted by means of a mounting plate 50 mounted on the burner head holding device 43.

Figure 9:
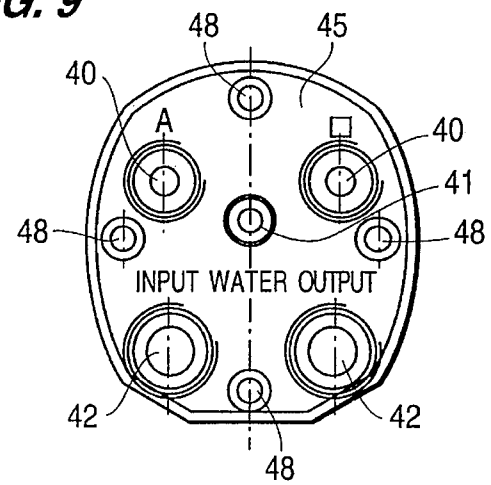
FIG. 9 is a view in the direction IX according to FIG. 8.

In FIG. 9, which is a view in the direction A according to FIG. 8, the connection is shown, which is easy to accomplish, of the fuel constituents to the fuel constituent feed lines 40 as well as of the spraying filler to the spraying filler feed line 41 and of the cooling water to the cooling water connections 42 on the connection piece of the burner gun. In FIG. 9, A and O respectively represent acetylene and oxygen.

Figure 10:
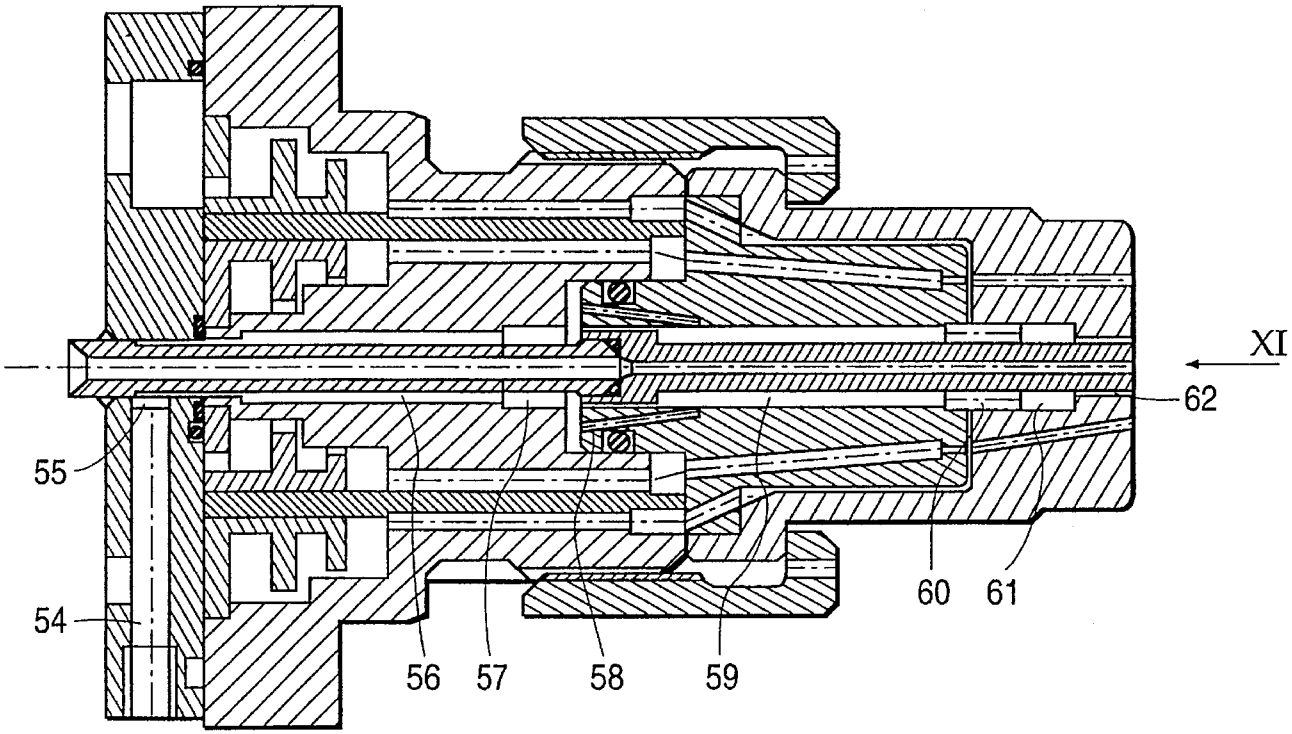
FIG. 10 is a sectional view like FIG. 3 but of another embodiment of the burner head according to the invention.

FIG. 10 is a sectional view of a burner head according to the invention by means of which the spraying filler jet, when emerging from the burner head face 30, can be provided with an enveloping gas which surrounds it coaxially. For achieving specific flaming characteristics, as a function of the special chemical and physical characteristics of the used spraying fillers, for example, nitrogen, argon, carbon dioxide or dry oil-free compressed air, in special cases also oxygen or forming gas, as well as water vapor or overheated water vapor at a pressure which is larger or equal to the combustion chamber pressure during the combustion, may be introduced into the enveloping gas duct 54, from where they reach the distributor annulus 55 for the purpose of an equal distribution around the spraying filler feed duct 38 in order to, from there, be guided through the coaxial duct 56, the pressure compensation annulus 57, the coaxial annular duct 59 and the passage bores of the centering ring 60, into the pressure compensation annulus 61, in order to finally, equally distributed in a coaxial manner, flow out through the annular duct 62 on the burner head face 30 in the shape of a hose. In order to achieve a precise coaxial equal distribution of the enveloping gas, this gas is guided between the pressure compensation annulus 57 and the coaxial annular duct 59 by way of gas distributor bores 58. The course of the section of this figure does not correspond precisely to that of FIG. 3. The distributor groove 39" is therefore not shown.

Figure 11:
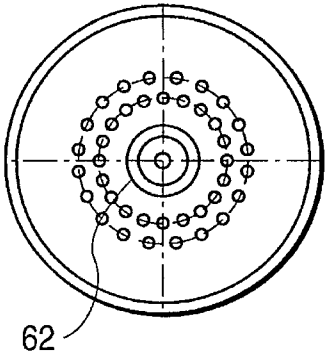
FIG. 11 is a view in the direction XI according to FIG. 10.

FIG. 11, which is a view in the direction A of FIG. 10, shows the annular duct 62 which is arranged coaxially around the spraying filler feed duct 38 and from where the enveloping gas emerges on the burner head face.

Figure 12:
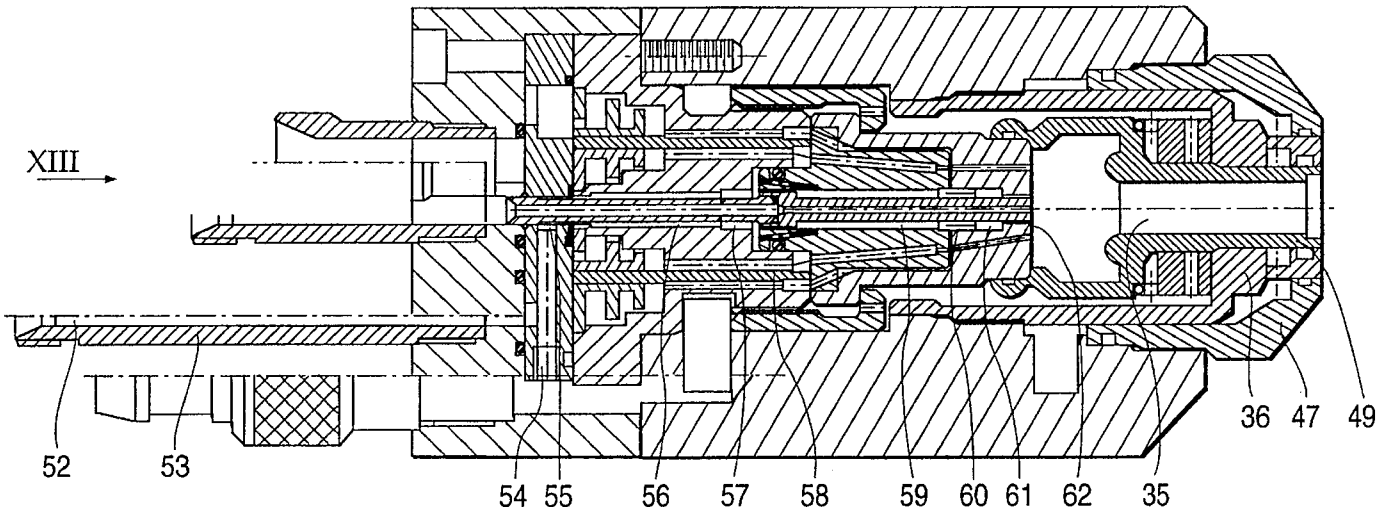
FIG. 12 is a sectional view like FIG. 8 but of another embodiment of a burner gun.

Like FIG. 8, FIG. 12 is a sectional view of a burner gun with a burner head according to the invention, in which case the burner head corresponds to a construction as illustrated in FIG. 10, and the burner gun is modified with respect to the construction of FIG. 8. The spraying filler guide duct 38 is surrounded in the intermediate piece 1, in the center part 9 and in the cap part 12, as in FIG. 10, by a coaxial duct 56, a pressure compensation annulus 57, gas distributor bores 58, a coaxial annular duct 59, a centering ring 60 with passage bores, a pressure compensation annulus 61 and an annular duct 62. These ducts and annuli are connected by way of a distributor annulus 55 and an enveloping gas duct 54 with an enveloping gas feed line 53 so that an enveloping gas, which is a cooling gas in the illustrated embodiment, can be charged into the flame range by way of an enveloping gas connection 52. The illustrated embodiment is particularly suitable for the high-speed (HVOF) flame spraying of low-melting reactive spraying fillers which, in the plastic and/or molten condition react extensively with oxygen. On the one hand, by means of the enveloping of the spraying filler jet by means of a cooling gas present at the enveloping gas connection 52, the temperature to which the spraying filler particles are heated, is reduced; on the other hand, the thermal stress to the spraying filler particles is further reduced because of the comparatively short construction of the expansion nozzle 35. Because of the short construction of the expansion nozzle 35, the expansion nozzle wall 49, the cooling jacket 36 and the exterior screw sleeve 47 will also be shorter.

Figure 13:
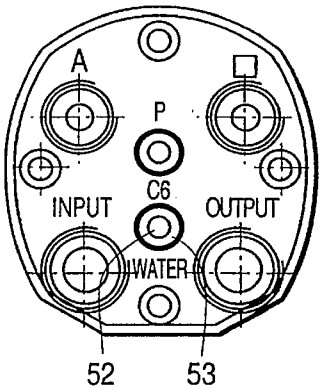
FIG. 13 is a view in the direction XIII according to FIG. 12.

FIG. 13, which is a view in the direction A according to FIG. 12, in comparison to FIG. 9, in addition, illustrates the enveloping gas connection 52, which in this embodiment is characterized as a cooling gas connection. In FIG. 13, A, O and CG respectively represent actylene, oxygen and cooling gas.

By means of the present invention, a burner head is therefore provided which generates a flame which forms rotationally symmetrically around the burner head axis and which, according to various embodiments, is advantageously suitable for flame spraying, particularly for the high-speed flame spraying of high-melting as well as reactive low-melting materials, in which case the invention is not limited to the embodiments illustrated here.

We claim:

1. A burner head, comprising:

an intermediate piece having a nozzle connecting side and comprising:

a plurality of sets of intermediate ducts for ducting fuel components supplied thereto to the nozzle connecting side of the intermediate piece; and radial-axial pressure compensation chambers respectively having inlets for receiving fuel components from fuel feed lines, and outlets, each outlet of the radial-axial pressure compensation chambers being connected to and supplying a respective one of the fuel components to a respective one of the plurality of sets of intermediate ducts, the radial-axial pressure compensation chambers being adapted for directing fuel flow from a generally axial direction at the inlets to a generally radial direction; and a nozzle connectable to the intermediate piece, the nozzle having a center part and a cap part with an annular radial injector gap therebetween, the center part comprising sets of center ducts, the center ducts of the each set of center ducts being distributed around a center axis of the burner head, the sets of center ducts respectively ducting fuel components from the set of intermediate ducts to the annular radial injector gap, wherein at least one of the sets of center ducts is connected to the annular radial injector gap via injector nozzle bores, the cap part is provided with nozzle ducts which are adapted to align with the injector nozzle bores and the cap part substantially covers the center part.

2. A burner head, comprising:

an intermediate piece having a nozzle connecting side and comprising:

a plurality of sets of intermediate ducts for ducting fuel components supplied thereto to the nozzle connecting side of the intermediate piece; and radial-axial pressure compensation chambers respectively having inlets, for receiving fuel components from fuel feed lines, and outlets, each outlet of the radial-axial pressure compensation chambers being connected to and supplying a respective one of the fuel components to a respective one of the plurality of sets of intermediate ducts, the radial-axial pressure compensation chambers being adapted for directing fuel flow from a generally axial direction at the inlets to a generally radial direction; and a nozzle connectable to the intermediate piece, the nozzle having a center part and a cap part with an annular radial injector gap therebetween, the center part comprising sets of center ducts, the center ducts of the each set of center ducts being distributed around a center axis of the burner head, the sets of center ducts respectively ducting fuel components from the set of intermediate ducts to the annular radial injector gap, wherein the radial-axial pressure compensation chambers have an annular construction.

3. A burner head according to claim 2, wherein each radial-axial pressure compensation chamber forms a circle which is concentric with respect to the center axis of the burner head.

4. A burner head according to claim 2, further comprising a cooling space surrounding the cap part and holding a heat-dissipating medium.

5. A burner head according to claim 4, wherein the heat-dissipating medium is water.

6. A burner head, comprising:

an intermediate piece having a nozzle connecting side and comprising:

a plurality of sets of intermediate ducts for ducting fuel components supplied thereto to the nozzle connecting side of the intermediate piece; and radial-axial pressure compensation chambers respectively having inlets, for receiving fuel components from fuel feed lines, and outlets, each outlet of the radial-axial pressure compensation chambers being connected to and supplying a respective one of the fuel components to a respective one of the plurality of sets of intermediate ducts, the radial-axial pressure compensation chambers being adapted for directing fuel flow from a generally axial direction at the inlets to a generally radial direction; and a nozzle connectable to the intermediate piece, the nozzle having a center part and a cap part with an annular radial injector gap therebetween, the center part comprising sets of center ducts, the center ducts of the each set of center ducts being distributed around a center axis of the burner head, the sets of center ducts respectively ducting fuel components from the set of intermediate ducts to the annular radial injector gap, wherein the radial-axial pressure compensation chambers are provided with baffles.

7. A burner head according to claim 6, wherein the baffles are made of one of stainless steel and brass.

8. A burner head according to claim 6, wherein the baffles have an annular construction.

9. A burner head according to claim 6, wherein the baffles comprise at least one exchangeable filter stage.

10. A burner head, comprising:

an intermediate piece having a nozzle connecting side and comprising:

a plurality of sets of intermediate ducts for ducting fuel components supplied thereto to the nozzle connecting side of the intermediate piece; and radial-axial pressure compensation chambers respectively having inlets, for receiving fuel components from fuel feed lines, and outlets, each outlet of the radial-axial pressure compensation chambers being connected to and supplying a respective one of the fuel components to a respective one of the plurality of sets of intermediate ducts, the radial-axial pressure compensation chambers being adapted for directing fuel flow from a generally axial direction at the inlets to a generally radial direction; and a nozzle connectable to the intermediate piece, the nozzle having a center part and a cap part with an annular radial injector gap therebetween, the center part comprising sets of center ducts, the center ducts of the each set of center ducts being distributed around a center axis of the burner head, the sets of center ducts respectively ducting fuel components from the set of intermediate ducts to the annular radial injector gap, wherein the radial-axial pressure compensation chambers are at least partially filled with a gas-permeable porous material.

11. A burner head according to claim 10, wherein the gas-permeable porous material is one of a ceramic foam and a ceramic preform.

12. A burner head according to claim 10, wherein the gas-permeable porous material comprises an open-pore sintered metal.

13. A burner head, comprising:

an intermediate piece having a nozzle connecting side and comprising:

a plurality of sets of intermediate ducts for ducting fuel components supplied thereto to the nozzle connecting side of the intermediate piece; and radial-axial pressure compensation chambers respectively having inlets, for receiving fuel components from fuel feed lines, and outlets, each outlet of the radial-axial pressure compensation chambers being connected to and supplying a respective one of the fuel components to a respective one of the plurality of sets of intermediate ducts, the radial-axial pressure compensation chambers being adapted for directing fuel flow from a generally axial direction at the inlets to a generally radial direction; and a nozzle connectable to the intermediate piece, the nozzle having a center part and a cap part with an annular radial injector gap therebetween, the center part comprising sets of center ducts, the center ducts of the each set of center ducts being distributed around a center axis of the burner head, the sets of center ducts respectively ducting fuel components from the set of intermediate ducts to the annular radial injector gap, wherein the center ducts of at least one of the sets of center ducts are arranged circumferentially, between the center part and the cap part and thermal bridges are provided connecting the center part to the cap part, the thermal bridges being arranged between the center ducts which are circumferentially arranged.

14. A burner head according to claim 13, wherein the center ducts which are circumferentially arranged, are formed by grooves in one of the center part and the cap part.

15. A burner head comprising:

an intermediate piece having a nozzle connecting side and comprising:

a plurality of sets of intermediate ducts for ducting fuel components supplied thereto to the nozzle connecting side of the intermediate piece; and radial-axial pressure compensation chambers respectively having inlets, for receiving fuel components from fuel feed lines, and outlets, each outlet of the radial-axial pressure compensation chambers being connected to and supplying a respective one of the fuel components to a respective one of the plurality of sets of intermediate ducts, the radial-axial pressure compensation chambers being adapted for directing fuel flow from a generally axial direction at the inlets to a generally radial direction;

a nozzle connectable to the intermediate piece, the nozzle having a center part and a cap part with an annular radial injector gap therebetween, the center part comprising sets of center ducts, the center ducts of the each set of center ducts being distributed around a center axis of the burner head, the sets of center ducts respectively ducting fuel components from the set of intermediate ducts to the annular radial injector gap; and a combustion chamber with a transition cone and an expansion nozzle mounted on a face of the burner head.

16. A burner head according to claim 15, further comprising:

a cooling jacket surrounding the combustion chamber, the transition cone and the expansion nozzle;

a cooling space surrounding the cap part and holding a heat dissipating medium; and cooling ducts connected with the cooling space.

17. A burner head, comprising:

an intermediate piece having a nozzle connecting side and comprising:

a plurality of sets of intermediate ducts for ducting fuel components supplied thereto to the nozzle connecting side of the intermediate piece; and radial-axial pressure compensation chambers respectively having inlets, for receiving fuel components from fuel feed lines, and outlets, each outlet of the radial-axial pressure compensation chambers being connected to and supplying a respective one of the fuel components to a respective one of the plurality of sets of intermediate ducts, the radial-axial pressure compensation chambers being adapted for directing fuel flow from a generally axial direction at the inlets to a generally radial direction; and a nozzle connectable to the intermediate piece, the nozzle having a center part and a cap part with an annular radial injector gap therebetween, the center part comprising sets of center ducts, the center ducts of the each set of center ducts being distributed around a center axis of the burner head, the sets of center ducts respectively ducting fuel components from the set of intermediate ducts to the annular radial injector gap, wherein the intermediate piece has distributor grooves which are gastight and which respectively connect the fuel feed lines to the radial axial pressure compensation chambers.

18. A burner head comprising:

an intermediate piece having a nozzle connecting side and comprising:

a plurality of sets of intermediate ducts for ducting fuel components supplied thereto to the nozzle connecting side of the intermediate piece; and radial-axial pressure compensation chambers respectively having inlets, for receiving fuel components from fuel feed lines, and outlets, each outlet of the radial-axial pressure compensation chambers being connected to and supplying a respective one of the fuel components to a respective one of the plurality of sets of intermediate ducts, the radial-axial pressure compensation chambers being adapted for directing fuel flow from a generally axial direction at the inlets to a generally radial direction;

a nozzle connectable to the intermediate piece, the nozzle having a center part and a cap part with an annular radial injector gap therebetween, the center part comprising sets of center ducts, the center ducts of the each set of center duct being distributed around a center axis of the burner head, the sets of center ducts respectively ducting fuel components from the set of intermediate ducts to the annular radial injector gap;

a spraying filler guide duct extending throughout the intermediate piece, the center part and the cap part;

a coaxial duct surrounding the spraying filler guide duct in the intermediate piece;

an annular duct coaxially surrounding the spraying filler guide duct in the cap part; and a coaxial annular duct leading into the annular duct and surrounding the spraying filler guide duct in the center part.

19. A burner head according to claim 18, wherein, in a contact area of the center part and the cap part, a centering ring with passage bores is arranged in the coaxial annular duct.

20. A burner head according to claim 18, further comprising a pressure compensation annulus arranged between the coaxial annular duct and the annular duct.

21. A burner head according to claim 18, further comprising gas distributor bores distributed on a circumference of the center part and between the coaxial duct of the intermediate piece and the coaxial annular duct of the center part.

22. A burner head according to claim 18, further comprising a distributor annulus and an enveloping gas duct to connect the coaxial duct with an enveloping gas feed line.

23. A burner head according to claim 18, wherein the coaxial duct, the coaxial annular duct and the annular duct are adapted to have water vapor and superheated water vapor flow therethrough.

* * * * *